US008230842B2

(12) United States Patent
Hoag

(10) Patent No.: US 8,230,842 B2
(45) Date of Patent: Jul. 31, 2012

(54) EVAPORATIVE EMISSION DEVICE TO MOTOR VEHICLE COUPLING

(75) Inventor: Richard W. Hoag, Caledonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/911,311

(22) Filed: Oct. 25, 2010

(65) Prior Publication Data

US 2012/0097135 A1 Apr. 26, 2012

(51) Int. Cl.
*F02M 33/02* (2006.01)
*F02M 33/00* (2006.01)

(52) U.S. Cl. ..... 123/518

(58) Field of Classification Search ..... 123/516, 123/518, 519, 520; 137/587, 588, 589
See application file for complete search history.

(56) References Cited

U.S. PATENT DOCUMENTS

| | | | | |
|---|---|---|---|---|
| 5,951,050 | A * | 9/1999 | Siekmann | 280/830 |
| 6,390,073 | B1 | 5/2002 | Meiller et al. | |
| 6,537,355 | B2 | 3/2003 | Scardino et al. | |
| 6,904,928 | B2 * | 6/2005 | Powell et al. | 137/202 |
| 7,124,748 | B2 * | 10/2006 | Gaffield et al. | 123/509 |
| 2005/0081717 | A1 | 4/2005 | Meiller et al. | |

* cited by examiner

*Primary Examiner* — Mahmoud Gimie
(74) *Attorney, Agent, or Firm* — Thomas N. Twomey

(57) ABSTRACT

A coupling is provided for attaching an evaporative emission device having a housing to a mounting surface of a motor vehicle. The coupling includes a pair of tracks fixed the mounting surface and a pair of matching rails fixed to the housing. The rails are sized to slide within the tracks until reaching a predetermined seated position within the rails. An aperture is fixed to the mounting surface and includes a shoulder with a manufacturing tolerance defined about a nominal location at the predetermined seated position. A resilient latch is formed on the housing and located so as to snap into the aperture at the predetermined seated position. The latch includes a inclined engaging surface to engage the shoulder over the entire tolerance range of the shoulder.

16 Claims, 4 Drawing Sheets

EVAPORATIVE EMISSION DEVICE TO MOTOR VEHICLE COUPLING

TECHNICAL FIELD OF INVENTION

The invention relates to an evaporative emission device for preventing discharge of fuel vapors from the fuel system of a motor vehicle, more particularly to a coupling for attaching an evaporative emission device to a motor vehicle, and more particularly to a latch for preventing separation of the evaporative emission device from the motor vehicle, and even more particularly to such a latch which can accommodate manufacturing variations of the coupling.

BACKGROUND OF INVENTION

Motor vehicles are typically equipped with evaporative emission devices in order to prevent the fuel system of the motor vehicle from discharging fuel vapors to the atmosphere which can result in air pollution. Evaporative emission devices are mounted to the motor vehicle and typically include a housing containing activated carbon. A conduit is included for providing fluid communication between the evaporative emission and a volume of the fuel tank that does not contain fuel. Fuel vapors are absorbed by the activated carbon while air is allowed to be purged from the evaporative emission device. When the internal combustion engine of the motor vehicle is running, the fuel vapors absorbed by the activated carbon may be purged from the evaporative emission device and consumed by the internal combustion engine.

One known coupling for attaching the evaporative emission device to the motor vehicle is commonly referred to as a dovetail coupling. In a dovetail coupling, a housing of the evaporative emission device includes a pair of converging rails forming a male portion of the coupling. The motor vehicle includes a mounting surface with a pair of matching converging tracks forming a female portion of the coupling. The converging tracks are sized to slidably receive the converging rails therewithin. When the evaporative emission device is assembled to the motor vehicle, the converging rails are slid into the converging tracks to a predetermined seated position. In order prevent the evaporative emission canister from decoupling from the motor vehicle during operation of the motor vehicle, the coupling also includes an aperture formed in the mounting surface of the motor vehicle in order to receive a latch formed on the housing of the evaporative emission device. However, prior art dovetail couplings do not substantially prevent relative movement between the evaporative emission device and the motor vehicle throughout the tolerance range to which the coupling may be manufactured. This relative movement may result in objectionable noise and possible damage to the coupling. Additionally, prior art dovetail couplings may not permit the latch to be received within the aperture throughout the tolerance range to which the coupling may be manufactured. This condition prevents the evaporative emission device from being properly secured to the motor vehicle.

What is needed is a coupling with a latch received in an aperture that will substantially prevent relative movement between an evaporative emission device and a motor vehicle throughout the tolerance range to which the coupling may be manufactured. What is also needed is a coupling with a latch that will be received within an aperture throughout the tolerance range to which the coupling may be manufactured.

SUMMARY OF THE INVENTION

Briefly described, a coupling is provided for attaching an evaporative emission device having a housing to a mounting surface of a motor vehicle. The coupling includes a pair of tracks fixed to one of the housing and the mounting surface. The coupling also includes a pair of matching rails fixed to the other of the housing and the mounting surface. The rails are sized to slide within the tracks until reaching a predetermined seated position within the rails. An aperture is fixed to one of the housing and the mounting surface. The aperture includes a shoulder with a manufacturing tolerance defined about a nominal location at the predetermined seated position. A resilient latch is fixed to the other of the housing and the mounting surface and located so as to snap into the aperture at the predetermined seated position. The latch includes an inclined engaging surface to engage the shoulder over the entire tolerance range of the shoulder.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1A:
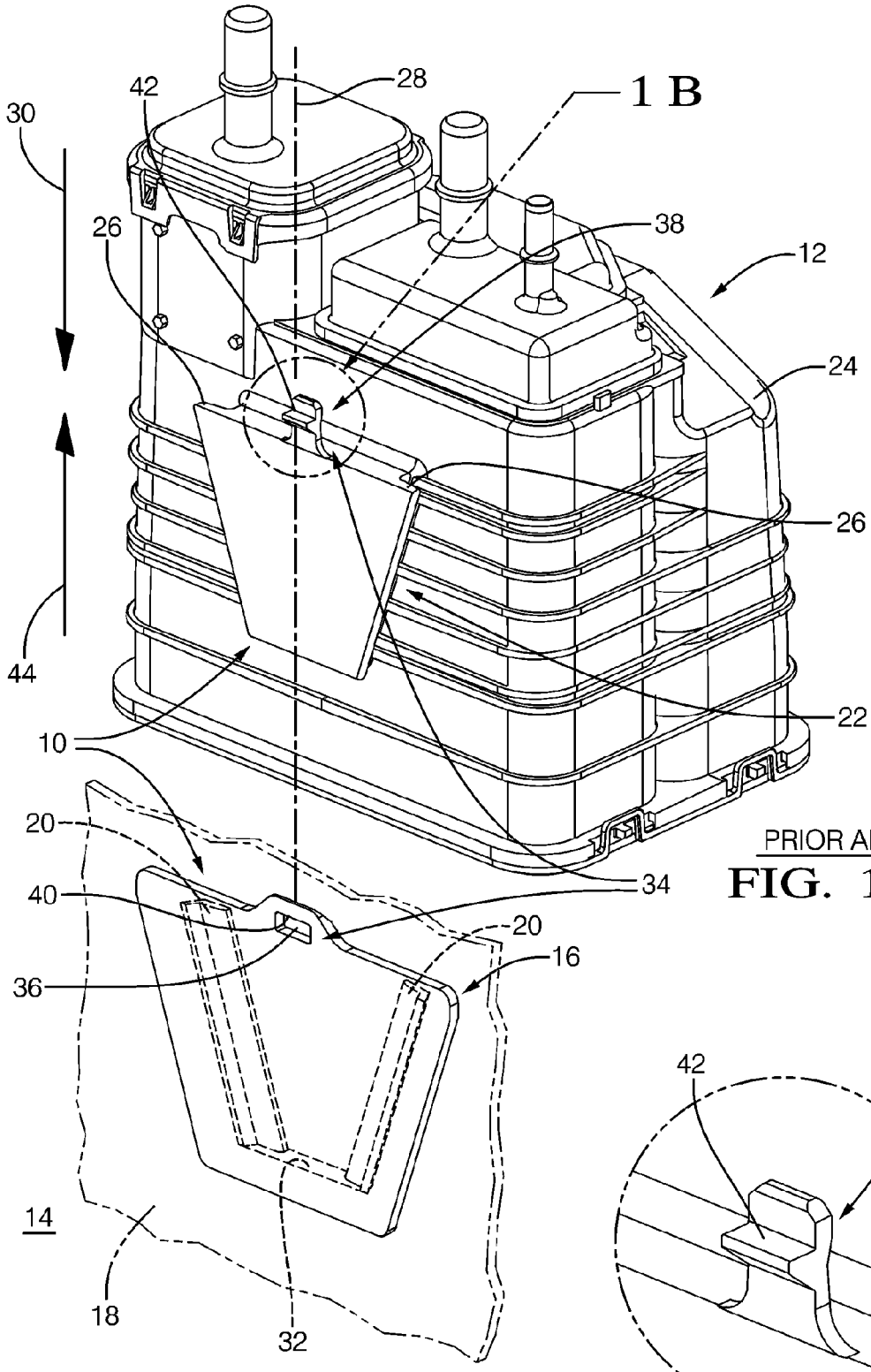
PRIOR ART FIG. 1 A
FIG. 1A is an isometric view of a prior art evaporative emission device and coupling for attaching the evaporative emission device to a motor vehicle.
Figure 1B:
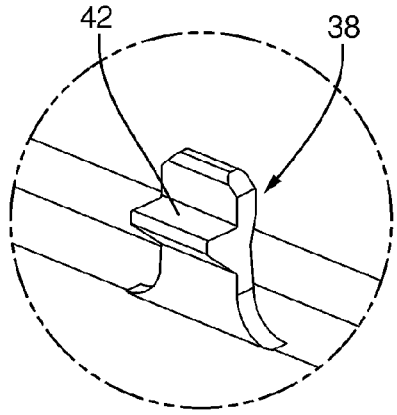
PRIOR ART FIG. 1 B
FIG. 1B is an enlarged isometric view of a latch of the coupling of FIG. 1A.
Figures 4A, 4B, 4C:
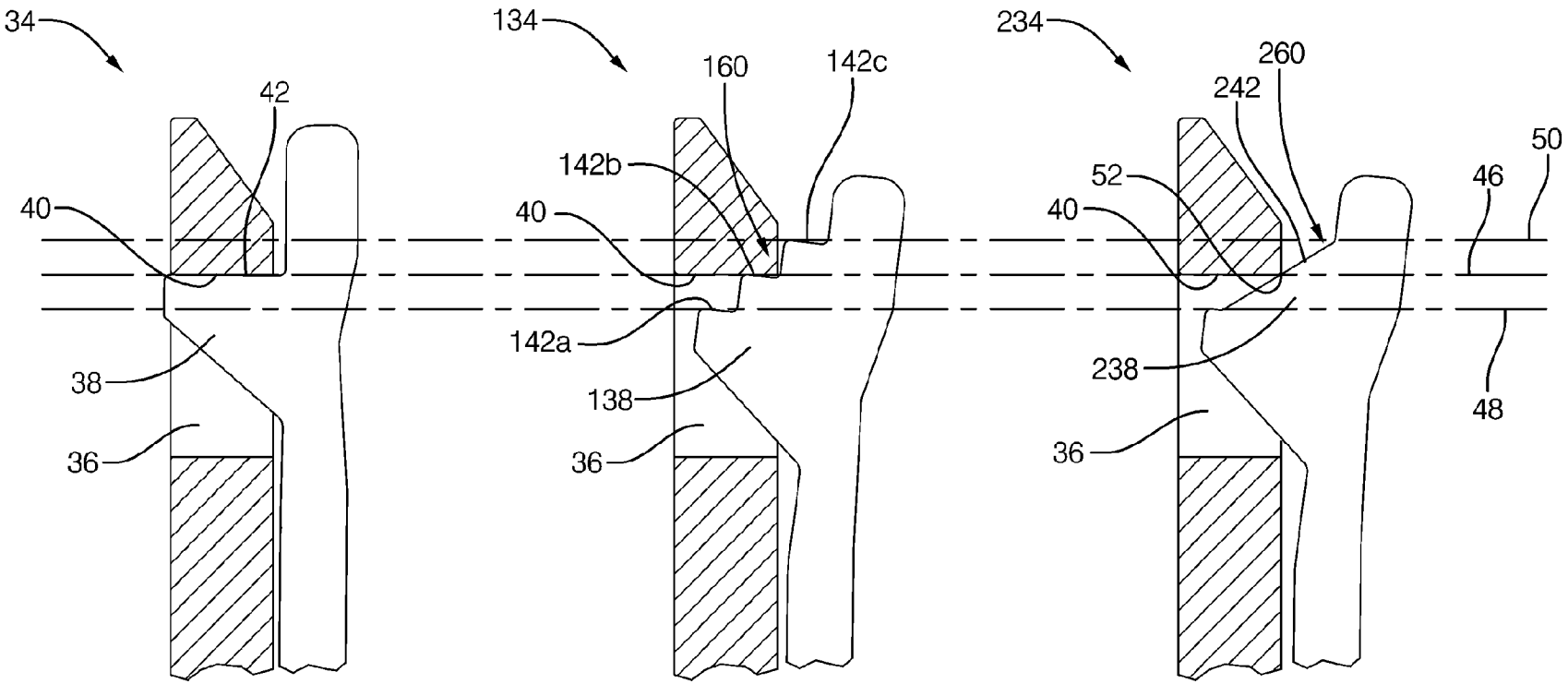
FIG. 4 B PRIOR ART
FIG. 4A is an enlarged elevation view of the latch of the prior art coupling of FIGS. 1A and 1B after the evaporative emission device has been attached to the motor vehicle.
FIG. 4B is an enlarged elevation view of a latch of the coupling of FIGS. 2A and 2B after the evaporative emission device has been attached to the motor vehicle.
FIG. 4C is an enlarged elevation view of a latch of the coupling of FIGS. 3A and 3B after the evaporative emission device has been attached to the motor vehicle.

Referring to FIGS. 1A, 1B, and 4A, a prior art coupling 10 for attaching evaporative emission device 12 to motor vehicle 14 is shown. Coupling 10 includes receiving member 16 fixed to mounting surface 18 of motor vehicle 14. Mounting surface 18 may be, for example, a fuel tank or a chassis member. Receiving member 16 includes a pair of converging tracks 20 defining a female dovetail portion of coupling 10 which may be made of a thermoplastic, for example, polypropylene. Alternatively, receiving member 16 may be made of metal, for example, steel.

Coupling 10 also includes insertion member 22 fixed to housing 24 of evaporative emission device 12. Insertion member 22 may be integrally molded as one piece with housing 24 which may be made of a thermoplastic such as nylon.

Alternatively, insertion member 22 may be made separate from housing 24 and subsequently joined to housing 24 by known methods such as welding, adhesives, or mechanical fasteners such as rivets or screws. Insertion member 22 includes a pair of matching converging rails 26 defining a male dovetail portion of coupling 10. Rails 26 are sized to slide within tracks 20 when insertion member 22 is inserted into receiving member 16 along insertion axis 28 in a first direction indicated by arrow 30.

Receiving member 16 includes stop surface 32 which connects tracks 20 to each other and defines a predetermined seated position for insertion member 22. Insertion member 22 is insertable into receiving member 16 until insertion member 22 abuts stop surface 32, thereby stopping at the predetermined seated position.

Coupling 10 is provided with retention member 34 for retaining insertion member 22 within receiving member 16. Retention member 34 includes aperture 36 formed in receiving member 16. Retention member 34 also includes latch 38 which is fixed to insertion member 22 and which is insertable into aperture 36 when insertion member 22 is inserted to the predetermined seated position within receiving member 16. Latch 38 flexes out of the way resiliently in order to allow insertion member 22 to be inserted within receiving member 16. Latch 38 then snaps into aperture 36 when insertion member 22 reaches the predetermined seated position and latch 38 is aligned with aperture 36. Shoulder 40 of aperture 36 acts against engaging surface 42 of latch 38 in order to prevent removal of insertion member 22 from receiving member 16 along insertion axis 28 in a second direction indicated by arrow 44 which is opposite to the first direction indicated by arrow 30. Shoulder 40 is substantially coplanar with engaging surface 42, however, some incidental mismatch may occur.

Now referring to FIG. 4A, an enlarged elevation view of latch 38 positioned within aperture 36 is shown such that shoulder 40 is positioned at a nominal position with respect to engaging surface 42 when insertion member 22 is seated against stop surface 32 at the predetermined seated position. The nominal position of shoulder 40 with respect to engaging surface 42 is most desirable because latch 38 is allowed to snap freely into aperture 36 while substantially preventing movement between evaporative emission device 12 and motor vehicle 14 along insertion axis 28. This nominal position is represented by nominal line 46. However, variations in manufacturing receiving member 16 and insertion member 22 allow the position of shoulder 40 to vary with respect to engaging surface 42. The minimum location of shoulder 40 with respect to engaging surface 42 is represented by minimum line 48 while the maximum location of shoulder 40 with respect to engaging surface 42 is represented by maximum line 50. As can be seen, a condition in which shoulder 40 is located at minimum line 48 fails to allow latch 38 to snap into aperture 36. As can also be seen, a condition in which shoulder 40 is located at maximum line 50 provides a gap between shoulder 40 and engaging surface 42, thereby allowing evaporative emission device 12 to move an undesirable magnitude relative to motor vehicle 14 along insertion axis 28.

Figure 2A:
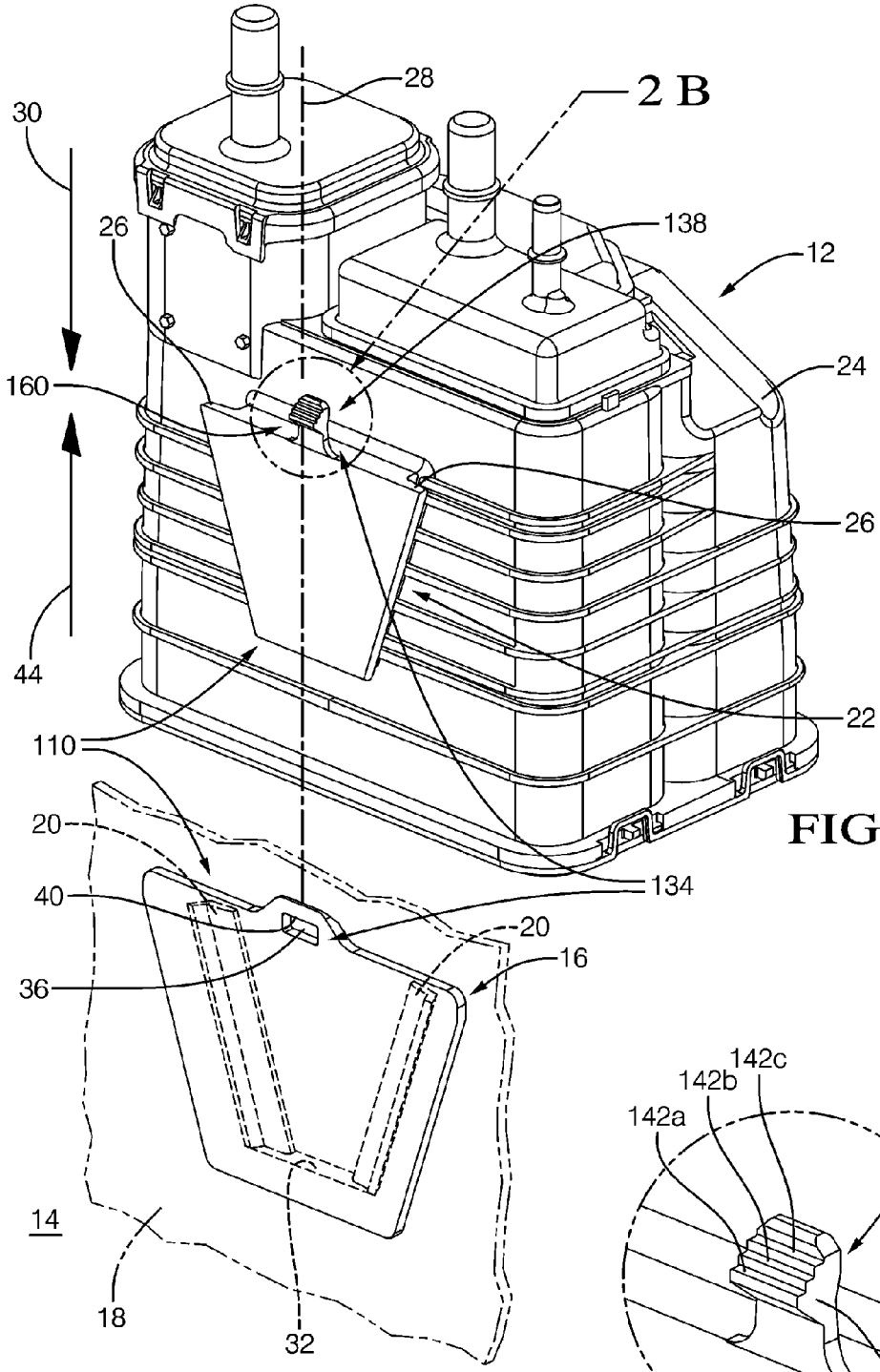
FIG. 2A is an isometric view of an evaporative emission device and coupling in accordance with the present invention for attaching the evaporative emission device to a motor vehicle.
Figure 2B:
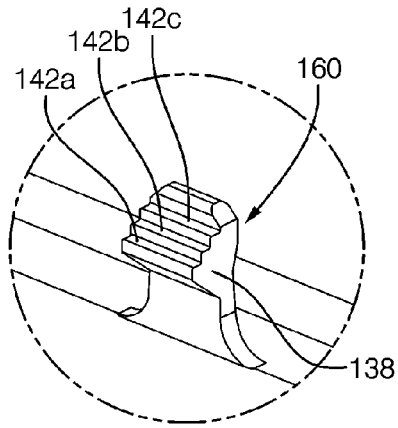
FIG. 2B is an enlarged isometric view of a latch of the coupling of FIG. 2A.

In accordance with a preferred embodiment of this invention and referring to FIGS. 2A, 2B, and 4B, coupling 110 is shown. Elements of coupling 110 that are substantially the same as elements of coupling 10 will use the same reference numbers while elements of coupling 110 that are not substantially the same as elements of coupling 10 will use one-hundred series numbers.

Still referring to FIGS. 2A, 2B, and 4B, coupling 110 is similar to coupling 10 with the exception of retention member 134. Retention member 134 is similar to retention member 34 in that aperture 36 is formed in receiving member 16. However, retention member 134 differs from retention member 34 in that latch 138 includes inclined engaging surface 160 for accommodating variations in manufacturing receiving member 16 and insertion member 22 which allow the position of shoulder 40 to vary with respect to latch 138. Inclined engaging surface 160 includes a plurality of steps that define a plurality of engaging surfaces 142*a*, 142*b*, 142*c*. Each engaging surface 142*a*, 142*b*, 142*c* is spaced a unique distance away from stop surface 32 when insertion member 22 is inserted within receiving member 16 to the predetermined seated position.

Now referring to FIG. 4B, an enlarged elevation view of latch 138 is shown positioned within aperture 36 such that shoulder 40 is positioned at a nominal position with respect to latch 138 when insertion member 22 is seated against stop surface 32 at the predetermined seated position. As can be seen, latch 138 is allowed to snap freely into aperture 36 while substantially preventing movement between evaporative emission device 12 and motor vehicle 14 along insertion axis 28 due to the close fit between shoulder 40 and engaging surface 42*b*. However, even when manufacturing variations allow the position of shoulder 40 to vary with respect to engaging surface 142*b* from the minimum location represented by minimum line 48 to the maximum location represented by line 50, latch 138 is allowed to snap freely into aperture 36 while substantially preventing movement between evaporative emission device 12 and motor vehicle 14 along insertion axis 28. This results from engagement surface 142*a* being positioned at minimum line 48 and from engagement surface 142*c* being positioned at maximum line 50. While the axial distance between each engagement surface 142*a*, 142*b*, 142*c* may still allow for some movement between evaporative emission device 12 and motor vehicle 14 along insertion axis 28, the magnitude of movement allowed by latch 138 of coupling 110 is greatly reduced compared to the magnitude of movement allowed by latch 38 of coupling 10. Furthermore, the number of engagement surfaces and the distance between each engagement surface can be designed to allow for an acceptable magnitude of movement between evaporative emission device 12 and motor vehicle 14 along insertion axis 28, thereby substantially preventing movement between evaporative emission device 12 and motor vehicle 14 along insertion axis 28. Shoulder 40 is substantially coplanar with each engaging surface 142*a*, 142*b*, 142*c*, however, some incidental mismatch may occur. The coplanar mismatch may be especially evident when engaging surface 142*a* or engaging surface 142*b* is abutted with shoulder 40. This is due to latch 238 remaining partially flexed when either engaging surface 142*a* or engaging surface 142*b* is abutted with shoulder 40.

Figures 3A, 3B:
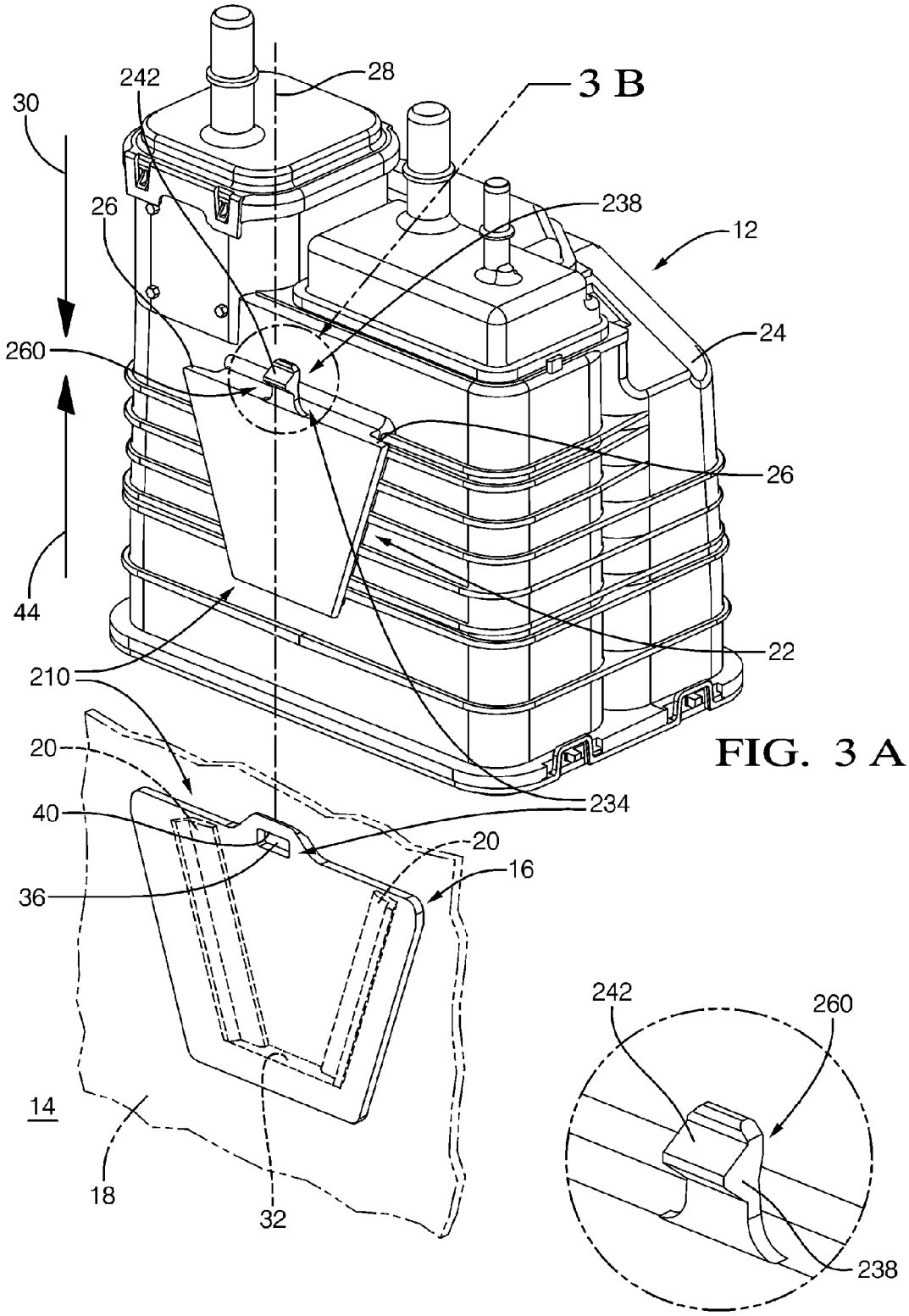
FIG. 3A is a an isometric view of a second embodiment of an evaporative emission device and coupling in accordance with the present invention for attaching the evaporative emission device to a motor vehicle.
FIG. 3B is an enlarged isometric view of a latch of the coupling of FIG. 3A.

In accordance with a second embodiment of this invention and referring to FIGS. 3A, 3B, and 4C, coupling 210 is shown. Elements of coupling 210 that are substantially the same as elements of couplings 10, 110 will use the same reference numbers while elements of coupling 210 that are not substantially the same as elements of couplings 10, 110 will use two-hundred series numbers.

Still referring to FIGS. 3A, 3B, and 4C, coupling 210 is similar to coupling 110 with the exception of retention member 234. Retention member 234 is similar to retention member 134 in that aperture 36 is formed in receiving member 16. However, retention member 234 differs from retention member 134 in that latch 238 includes inclined engaging surface 260 for accommodating variations in manufacturing receiving member 16 and insertion member 22 which allow the position of shoulder 40 with respect to latch 138 to vary. Rather than including a plurality of steps defining a plurality of engaging surfaces 142*a*, 142*b*, 142*c* as in inclined engaging surface 160, inclined engaging surface 260 includes tapered engaging surface 242 which is substantially planar and which is inclined to shoulder 40.

Now referring to FIG. 4C, an enlarged elevation view of latch 238 is shown positioned within aperture 36 such that shoulder 40 is positioned at a nominal position with respect to latch 238 when insertion member 22 is seated against stop surface 32 at the predetermined seated position. As can be seen, latch 238 is allowed to snap freely into aperture 36 while substantially preventing movement between evaporative emission device 12 and motor vehicle 14 along insertion axis 28. However, even when manufacturing variations allow the position of shoulder 40 to vary with respect to tapered engaging surface 242 from the minimum location represented by minimum line 48 to the maximum location represented by line 50, latch 238 is allowed to snap freely into aperture 36 while substantially preventing movement between evaporative emission device 12 and motor vehicle 14 along insertion axis 28. This results from the upper-most and lower-most portions of tapered engaging surface 242 being located between the minimum location of shoulder 40 with respect to engaging surface 42 and the maximum location of shoulder 40 with respect to engaging surface 42. The same force that causes latch 238 to snap into aperture 36 after flexing out of the way in order to allow insertion member 22 to be inserted within receiving member 16 also urges tapered engaging surface 242 tightly against corner 52 of aperture 36. With tapered engaging surface 242 pressed tightly against corner 52, movement between evaporative emission device 12 and motor vehicle 14 along insertion axis 28 is substantially prevented. Furthermore, tapered engaging surface 242 substantially prevents movement between evaporative emission device 12 and motor vehicle 14 along insertion axis 28 when shoulder 40 of aperture 36 is manufactured to fall at any location between the minimum location represented by minimum line 48 and the maximum location represented by maximum line 50.

Corner 52 may interface particularly well with tapered engaging surface 242 when aperture 36 is formed in metal. This is because the sharp nature of corner 52 may "bite" into the softer tapered engaging surface 242, thereby assisting to prevent movement. However, if aperture 36 is formed in plastic, shoulder 40 may be formed at an angle (not shown) which substantially matches the angle of inclined engaging surface 242. This allows a surface contact between the shoulder and the inclined engaging surface rather than a line contact as shown in FIG. 4C. Similarly, forming the shoulder at an angle which substantially matches the angle of inclined engaging surface 242 may also be used when the aperture is formed in metal.

While the coupling has been described in terms of converging tracks and matching converging rails sized to slide within the converging tracks, it should be understood that other arrangements also fall within the scope of this invention. Another non-limiting example is parallel tracks and matching parallel rails sized to slide within the parallel tracks.

While the receiving member has been described as being fixed to the motor vehicle, it should now be understood that the receiving member may instead be fixed to the housing of the evaporative emission device. Similarly, when the receiving member is fixed to the evaporative emission device, the insertion member may be fixed to the motor vehicle rather than the housing of the evaporative emission device.

While the aperture of the retention member has been described as being formed in the receiving member, it should now be understood that the aperture may instead be formed any member fixed in relation to one of the receiving member and the insertion member. Similarly, the latch may be fixed to any member fixed in relation to the other of the receiving member and the insertion member.

While this invention has been described in terms of the preferred embodiments thereof, it is not intended to be so limited, but rather only to the extent set forth in the claims that follow.

I claim:

1. For use in a motor vehicle having a mounting surface to which is mounted an evaporative emission device having a housing, a coupling for attaching the evaporative emission device to the motor vehicle, the coupling comprising:

a pair of tracks fixed to one of said housing and said mounting surface;

a pair of matching rails fixed to the other of said housing and said mounting surface, said rails being sized to slide within said tracks until reaching a predetermined seated position therewithin;

an aperture fixed to one of said housing and said mounting surface, said aperture having a shoulder with a manufacturing tolerance range defined about a nominal location at said predetermined seated position;

a resilient latch fixed to the other of said housing and said mounting surface and located so as to snap into said aperture at said predetermined seated position when said rails slide within said tracks, said latch including an inclined engaging surface thereon sufficient to engage said shoulder over the entire tolerance range of said shoulder.

2. A coupling as in claim 1 wherein said inclined engaging surface comprises a plurality of steps defining a plurality of engaging surfaces.

3. A coupling as in claim 2 wherein one of said plurality of engaging surfaces is abutted with said shoulder at said predetermined seated position.

4. A coupling as in claim 1 wherein said inclined engaging surface is a tapered engaging surface.

5. A coupling as in claim 4 wherein said tapered engaging surface is substantially planar and inclined to said shoulder.

6. A coupling as in claim 5 wherein said tapered engaging surface is inclined to said shoulder over the entire tolerance range of said shoulder.

7. A coupling as in claim 1 wherein said pair of tracks is fixed to said mounting surface and said pair of rails is fixed to said housing.

8. A coupling as in claim 7 wherein said latch is fixed to said housing and said aperture is fixed to said mounting surface.

9. A coupling as in claim 1 wherein said inclined engaging surface is a tapered engaging surface.

10. A coupling as in claim 9 wherein said tapered engaging surface is substantially planar and inclined to said shoulder.

11. A coupling for attaching an evaporative emissions device with a housing to a motor vehicle, the coupling comprising:

a receiving member fixed to one of said motor vehicle and said housing;

an insertion member fixed to the other of said motor vehicle and said housing, said insertion member being linearly insertable into said receiving member along an axis in a first direction until reaching a predetermined seated position therewithin; and a retention member for retaining said insertion member within said receiving member, said retention member including a latch fixed to one of said insertion member and said receiving member, said latch being insertable within an aperture fixed to the other of said insertion member and said receiving member, said aperture defining a shoulder with a manufacturing tolerance range defined about a nominal location at said predetermined seated position, whereby said retention member prevents said insertion member from being removed from said receiving member in a second direction which is opposite of said first direction;

wherein said latch includes an inclined engaging surface for accommodating variations in the distance between said shoulder and said latch, thereby substantially holding said insertion member at said predetermined seated position over the entire tolerance range of said shoulder.

12. A coupling as in claim 11 wherein said inclined engaging surface comprises a plurality of steps defining a plurality of engaging surfaces.

13. A coupling as in claim 12 wherein one of said plurality of engaging surfaces is abutted with said shoulder at said predetermined seated position.

14. A coupling as in claim 11 wherein said retention member is flexible in order to allow insertion of said latch into said aperture.

15. A coupling as in claim 11 wherein said receiving member is fixed to said motor vehicle and said insertion member is fixed to said housing.

16. A coupling as in claim 11 wherein said latch is fixed to said insertion member and said aperture is fixed to said receiving member.

* * * * *